United States Patent [19]

Babiol

[11] 4,089,463

[45] May 16, 1978

[54] SCREW CAPS

[75] Inventor: Pierre Babiol, Villefranche-sur-Saone, France

[73] Assignee: Societe Nouvelle de Bouchons Plastiques S.N.B.P., Paris, France

[21] Appl. No.: 759,608

[22] Filed: Jan. 14, 1977

[30] Foreign Application Priority Data

Jan. 28, 1976 France ..... 76 02855

[51] Int. Cl.[2] ..... B65D 41/04

[52] U.S. Cl. ..... 215/329; 215/344; 215/DIG. 1

[58] Field of Search ..... 215/329, 344, DIG. 1

[56] References Cited

U.S. PATENT DOCUMENTS

| | | | |
|---|---|---|---|
| 3,053,406 | 9/1962 | Wandell | 215/329 |
| 3,125,237 | 3/1964 | Kitterman | 215/329 |
| 3,151,757 | 10/1964 | Martin | 215/DIG. 1 |
| 3,232,470 | 2/1966 | Gibson | 215/329 |
| 3,255,907 | 6/1966 | Eddy | 215/DIG. 1 |
| 3,990,598 | 11/1976 | Zapp | 215/344 |

FOREIGN PATENT DOCUMENTS

| | | | |
|---|---|---|---|
| 987,260 | 4/1976 | Canada | 215/344 |
| 991,587 | 6/1976 | Canada | 215/344 |
| 1,150,059 | 1/1958 | France | 215/DIG. 1 |
| 564,461 | 7/1975 | Switzerland | 215/344 |
| 1,172,195 | 11/1969 | United Kingdom | 215/331 |

*Primary Examiner*—Ro E. Hart
*Attorney, Agent, or Firm*—Dowell & Dowell

[57] ABSTRACT

A screw threaded cap for stoppering and re-stoppering of bottles enclosing gaseous beverages such as beer, has a base comprising a resilient lip adapted to co-operate with the junction of the bore of the bottle neck and its end surface. Ribs limit the distance between the latter and the corresponding surface of the base. The upper portion of the skirt has a rounded profile preventing cracks.

3 Claims, 2 Drawing Figures

SCREW CAPS

The present invention relates to improvements applied to screw caps, and more particularly to those intended to cooperate with the threaded neck of a container in which high pressure prevails.

The stoppering of bottles of gaseous beverages such as beer or mineral water requires closures capable of resisting high pressures. A certain number of these devices are known but, in general, they do not enable the bottle to be re-closed when its content has not been completely used.

The improvements which form the subject of the present invention aim more particularly at providing a screw cap capable of being applied to necks whatever the diameter may be of their inner bore, which cap comprises an abutment adapted to limit the distance between the inner surface of its base and the end of the neck and further comprises is provided with a skirt of special cross-section preventing the appearance of cracks or even flaws in the case of a powerful screwing up tongue and permitting this special cross-section, furthermore, high temperatures and pressures to be withstood.

The accompanying drawing, given by way of example, enables the invention to be better understood, the features which it shows and the advantages which it is capable of providing:

Figure 1:
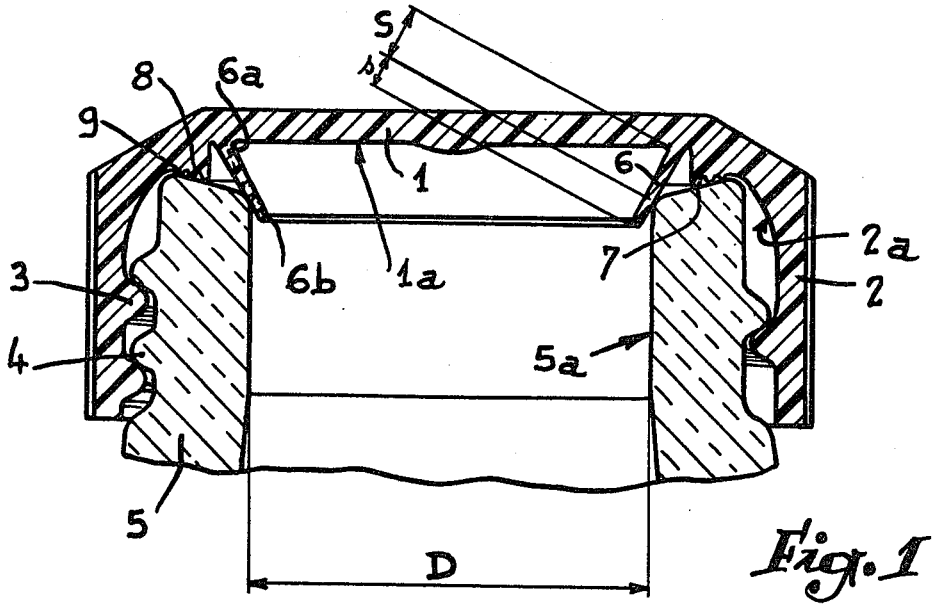
FIG. 1 is a transverse section of the neck of a container provided with a cap according to the invention.

The cap according to the invention shown in FIG. 1 and which is advantageously produced in polypropylene, comprises a circular base 1 around which is attached a skirt 2 provided with an internal screw thread 3 adapted to co-operate with threads 4 provided in the exterior of the neck 5 of a container. The inner surface 1*a* of the base 1 is integral with a lip 6 of generally truncated form and which, by reason of the material selected for the manufacture of the cap, has a certain elasticity. It will be noted that it is the large root 6*a* of the lip 6 which is associated with the base 1, whilst its small end 6*b* is situated a certain distance from the said base within the skirt 2. The portion of the base situated between the root 6*a* or the line of attachment of the lip 6 to the base 1 and the beginning of the skirt 2, comprises a certain number of concentric peripheral ribs 7, 8, 9, which are provided with decreasing heights in an outward direction. Between the rib 9 of largest diameter and the first thread of the screw thread 3, the inner surface 2*a* of the skirt 2 has a curved shape which, at this level, confers on it a considerable resistance to rupture. Advantageously, this portion 2*a* has the shape in cross-section of a semi-ellipse, which is connected to the rib 9 and to the first thread of the screw thread 3.

The conicity and the length of the lip 6 are clearly determined as a function of the nominal diameter of the screw thread 3 and also with respect to variations in the diameter of the bore 5*a* of the neck 5. In fact, that may vary within quite considerable limits for the same outer diameter. If it has been applied to a neck of which the diameter D of the bore 5*a* is a maximum, when the ribs 7, 8, 9 arrive in contact with the end of the neck, the free edge or small end 6*b* of the lip 6 is tightly engaged in the said bore, whilst the outer surface of the latter is forcibly applied against the junction of the said bore and the end of the neck, the cap being strongly screwed on to the latter. The extent of the screwing up is limited by the abutment of the ribs 7, 8, 9 against the end of the neck so that the portion of the skirt 2 situated at the level of its curved surface 2*a* is subjected to a considerable tensile force. However, the shape of the curve of the said portion prevents cracks appearing in the said skirt.

Figure 2:
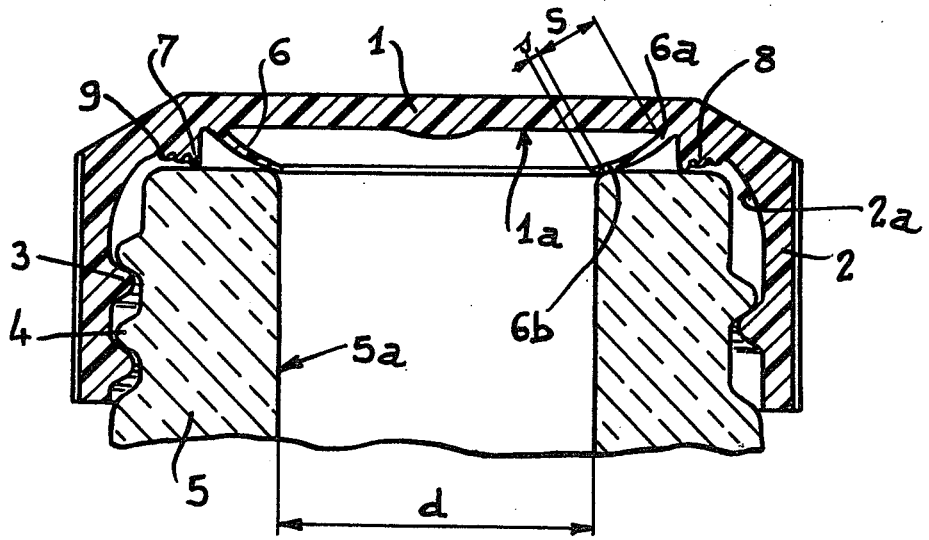
FIG. 2 is a view similar to that of FIG. 1 but illustrating the mounting of a cap on a neck of small internal diameter.

Certain necks have a concave end, that is to say that the end is truncated as shown in FIG. 1. Then, all the ribs are of importance and are applied against the said end. On the other hand, if the end of the neck is level, one or only two of the ribs co-operate with it (FIG. 2).

In that Figure, a neck is shown of which the diameter *d* of the bore 5*a* is much less than that of D shown in FIG. 1. In this case, the lip 6 co-operates with the neck along a line of contact which is practically at the level of its free edge or small end 6*b*. In this case, of course, the lip 6 is much more deformed towards the inner surface 1*a* of the base 1 but it never comes into contact with the latter due to the presence of the ribs 7, 8, 9.

The annular surface S included between the joining or large root 6*a* of the lip and its line of contact with the neck, is always greater than that *s* measured between the said line of contact and the free edge or small end 6*b* of the lip. For this reason, the elasticity of the latter, which to a great extent ensures fluid tightness, is increased by the force of the pressure inside the container applied to the difference (S-*s*) in the areas referred to. The effect of the inner gas pressure produces a deformation of the lip 6 which, in all cases, is applied against the annular end of the neck as illustrated in FIG. 2.

Of course, the cap could be produced in any material other than that provided above on condition that it provides the lip 6 with a sufficiently great elasticity.

Thus, a cap has been produced adapted to suitably stopper bottles of beer or similar gaseous products, and which permits their re-stoppering during the course of use. In fact, the shape and the disposition of the lip 6 and the outline of the inner connection surface 2*a* determine an increase in the fluid tightness and the general retention of the cap on the neck 5 when the pressure increases inside the container, because the force of application of the lip on the neck 5 is increased independently of the subsequent inflation of the base 1 which, by virtue of the shape of the surface 2*a*, produces a centripetal contraction of the skirt 2 on to the threads 4.

Furthermore, it must be understood that the previous description has been given only by way of example and that it in no way limits the scope of the invention which is not departed from by replacing the practical details described by any other equivalence.

I claim:

1. An elastic deformable screw cap for a container having a neck with external threads and having a bore extending through the upper end surface of the neck, the cap comprising:

a base portion having an inner surface facing toward said neck;

a flexible truncated conical lip extending downwardly from a root portion where it joins said inner surface of the base portion and converging toward a smaller free end of lesser diameter than said bore;

an annular abutment comprising multiple concentric ribs extending downwardly from the inner surface of the base portion toward the upper surface of the neck and surrounding said root portion and spaced therefrom, the concentric ribs extending lesser distances than said lip from said inner surface of the base portion and respectively extending to decreasing extents away from the root of the lip; and a skirt portion joining said base portion at its upper end and having internal threads adjacent to its lower end for engaging the threads on said neck, the skirt portion having a cross-sectional portion extending from the base portion to said internal threads along an inner surface which curves smoothly outwardly and downwardly from the outer concentric rib along an inner surface which is a portion of an ellipse and joins said internal threads at a distance below the free end of the lip at least equal to the height of the lip, said curved cross-sectional portion being deformable inwardly toward the neck when the skirt portion is tensioned by screwing the cap tightly on the neck.

2. A cap according to claim 1 characterized in that the height of the ribs is such that when they are applied against the end of the neck of the container, the lip is not completely flattened against the inner surface of the base.

3. A cap according to claim 1 characterized in that the annular area of the lip, defined by the line of contact of the lip with the neck of the container and its attachment to the base of the cap, is always greater than the area between the said line of contact and the free edge of the lip, with a view to bedding the said lip down against the annular end of the neck.

* * * * *